US006505748B2

(12) United States Patent
Ward

(10) Patent No.: US 6,505,748 B2
(45) **Date of Patent: *Jan. 14, 2003**

(54) MODULAR STORAGE RACK FOR STORING SPOOLED MATERIAL HAVING ARMS AND AN AXLE FOR DISPENSING THE SPOOLED MATERIAL

(76) Inventor: Michael D. Ward, 5302 Sudbury Way, Madison, WI (US) 53714

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/558,417

(22) Filed: Apr. 24, 2000

(65) Prior Publication Data

US 2001/0054596 A1 Dec. 27, 2001

Related U.S. Application Data

(60) Provisional application No. 60/171,986, filed on Dec. 23, 1999.

(51) Int. Cl.[7] ..... A47F 7/00

(52) U.S. Cl. ..... 211/85.5; 211/13.1

(58) Field of Search ..... 211/85.5, 193, 211/13.1, 60.1; 242/594.4, 594.6, 598.2, 598.3

(56) References Cited

U.S. PATENT DOCUMENTS

| | | | | | |
|---|---|---|---|---|---|
| 838,400 | A | * | 12/1906 | Griffin | 242/594.6 |
| 960,561 | A | * | 6/1910 | Krom | 312/34.18 |
| 1,217,409 | A | * | 2/1917 | Carlson | 242/594.6 |
| 1,250,255 | A | * | 12/1917 | Wardrop | 242/561 |
| 2,926,862 | A | * | 3/1960 | Jacobson | 242/596.4 |
| 3,835,793 | A | * | 9/1974 | Goddard | 108/109 |
| 4,533,091 | A | * | 8/1985 | Knight et al. | 242/129.6 |
| RE34,433 | E | * | 11/1993 | Heiligenthal et al. | 16/35 R |
| 5,518,127 | A | * | 5/1996 | Warmack et al. | 211/193 |
| 5,692,625 | A | * | 12/1997 | Filipescu et al. | 211/195 |
| 5,749,539 | A | * | 5/1998 | Ratzel et al. | 242/598.3 |

FOREIGN PATENT DOCUMENTS

| | | | | |
|---|---|---|---|---|
| DE | 451254 | * | 10/1927 | 242/594.4 |
| DE | 60628 | * | 11/1969 | 211/13.1 |

OTHER PUBLICATIONS

*Shelving Direct*, Cincinnati, Ohio, vol. 10, p. 7, date unknown.

* cited by examiner

*Primary Examiner*—Gregory J. Strimbu
(74) *Attorney, Agent, or Firm*—DeWitt Ross & Stevens SC; Charles S. Sara

(57) ABSTRACT

A rack for dispensing and storing spooled material. The rack has at least one platform for storing the spooled material, a support for maintaining the platform above the floor level, a pair of arms attached to the platform, and an axle for rotatably receiving the spooled material for dispensing there from. The axle is substantially horizontally supported by the arms away from a peripheral edge of the platform. In one embodiment, the arms include a plurality of notches for supporting the axle in one of a plurality of positions spaced from the platform. In another embodiment, the axle has one end pivotally attached to one of the arms and the other end received in a notch in the other arm.

4 Claims, 2 Drawing Sheets

MODULAR STORAGE RACK FOR STORING SPOOLED MATERIAL HAVING ARMS AND AN AXLE FOR DISPENSING THE SPOOLED MATERIAL

CROSS-REFERENCE TO RELATED APPLICATIONS

This application claims priority under 35 USC §119(e) to U.S. provisional patent application Ser. No. 60/171,986, filed Dec. 23, 1999, the entirety of which is incorporated by reference herein.

FIELD OF THE INVENTION

The invention relates to racks for dispensing and storing material on spools. In particular, the invention relates to racks that store and dispense wire and cable.

DESCRIPTION OF THE RELATED ART

Spooled materials, such as cable, wire, and thread, are used by manufacturing companies. For example, in the assembly of fire trucks, electrical wire of various parameters (e.g., gauge, polarity) is used is used in the fire trucks' information and diagnostic systems. Cable, such as data-link cable, is used to allow multiple signals to be sent through fewer wires. In fire trucks, the electrical systems built with the wire and cable allow officers to review fuel levels, diagnostic codes, maintenance issues, and more.

Spooled materials used at production lines, such as those that are used to build fire trucks, are dispensed on racks. Conventional dispensing racks, being situated along the production line, are physically separated from the area in which replacement spooled material is stored. Typically, this means that when a worker runs out of the material on a dispensing rack, work is halted, permission has to be obtained from a line foreman, the worker has to go to a storage area to obtain more spools, and the worker has to return with the spools to the dispensing rack. Having dispensing and storage areas separated from each other adds time and money to the production costs due to the time required for re-supplying the dispensing rack.

Conventional dispensing racks have other drawbacks as well. Because conventional dispensing racks do not permit storage of spools, extra storage space is required, adding to cost and space requirements. Oftentimes the stored spools are not well organized, leading to a further loss of time and space. Additionally, conventional racks require excess time from the supplier of the spooled material, who must observe both the dispensing and storage areas to determine the needs of the customer. Thus, what is needed is a rack that efficiently, neatly, and safely dispenses and stores spooled material and that allows safe and rapid replacement of exhausted spools with new spools.

SUMMARY OF THE INVENTION

The invention, which is defined by the claims set out at the end of this disclosure, is intended to solve at least some of the problems noted above. A rack is provided that both dispenses spooled material from spools and stores spools having spooled material thereon. Spooled materials include, but are not limited to, wire, cable, and thread.

An exemplary rack of this nature suspends spooled material above a floor and includes at least one platform, the platform having a peripheral edge, and being situated in a plane which is at least substantially horizontally oriented. A vertical support is connected to the platform at or near its peripheral edge. The platform has at least one axle for receiving the spooled material and is associated therewith. The axle is spaced from one of the vertical support and the peripheral edge of its platform.

Another exemplary rack of this nature suspends spooled material above a floor and includes at least one vertical support and at least one platform that is at least substantially planar, that is surrounded by a peripheral edge, and that is affixed to the vertical support. This version of the rack also has at least two axles, with each axle being spaced from its peripheral edge.

Still another exemplary rack suspends spooled material above a floor and includes a series of platforms, with each platform being at least substantially planar and being bounded by a peripheral edge. The platforms are aligned in a parallel array. The rack also has a series of pairs of arms, each pair being associated with a platform and a series of axles, with each axle being removably maintained between the arms in one of the pairs of arms at a location parallel to and spaced from the platform with which the one pair of arms is associated.

The exemplary platforms store spools. The support maintains the platform above the floor level. Spools are received onto the axle, which is at a peripheral edge of the platform.

By both storing and dispensing spools on a rack in accordance with the invention, the amount of space that is required to store and dispense spooled materials is reduced when compared to conventional dispensing racks, which require additional storage space that is usually distant from the rack.

Another version of the rack is a customized rack that fits any given space. In particular, this version can accommodate any floor space, any height, and any oddities in the structural layout of the space in which the rack will be placed. Furthermore, this version can be customized to accommodate the specific needs of a user. The spacing of the shelves and dispensing features can be designed to hold spooled materials of any size or gauge.

The rack can be installed at work sites having multiple assembly lines. For instance, when the rack is placed between two assembly lines, workers in both assembly lines use opposite sides of one rack to dispense spooled materials. This placement saves additional floor space.

Further advantages, features, and objects of the invention will be apparent from the following detailed description of the invention in conjunction with the associated drawings.

DETAILED DESCRIPTION OF THE INVENTION

Figure 1:
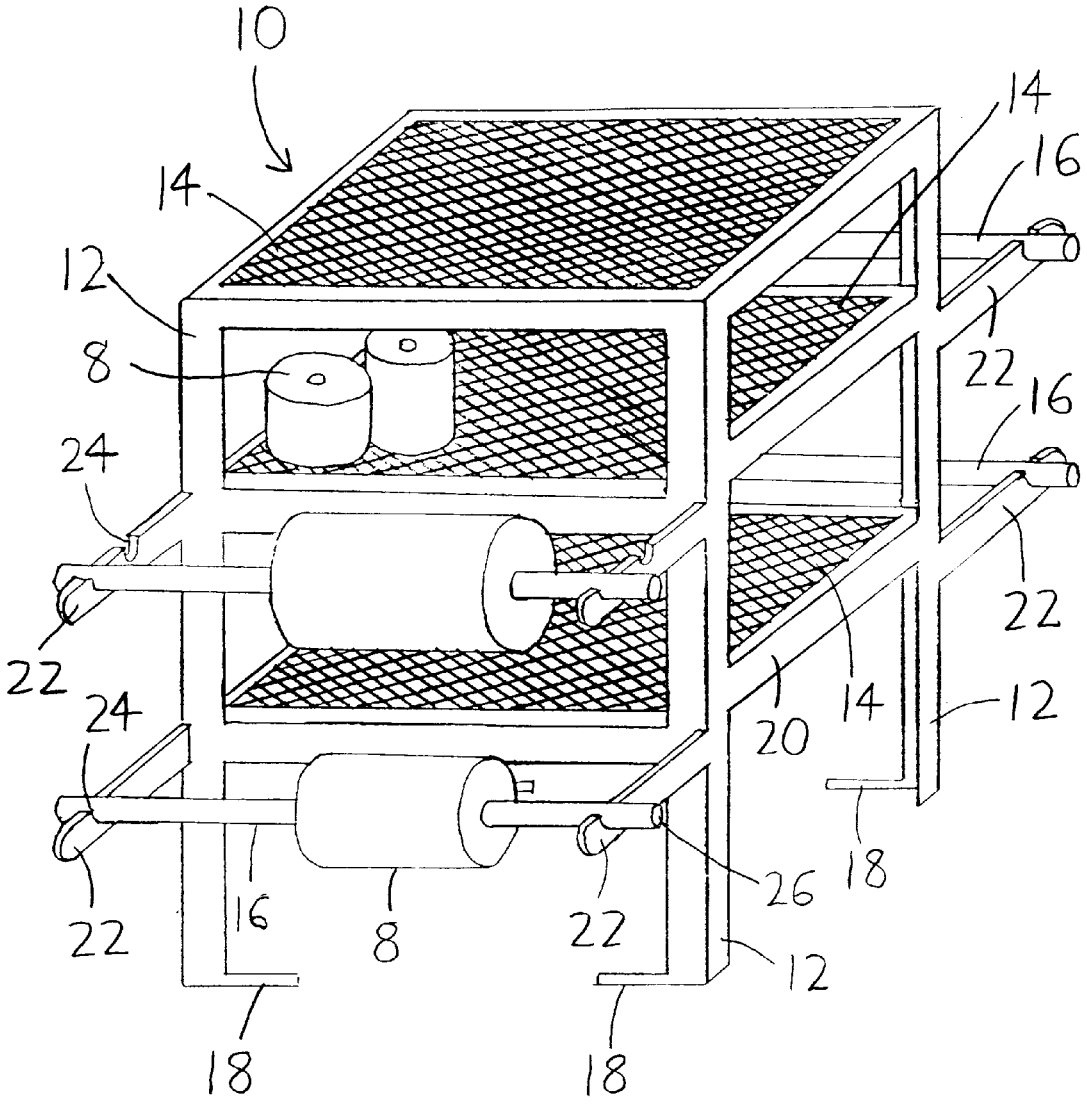
FIG. 1 is a perspective view of a preferred embodiment of a storing and dispensing rack having an axle that is removably mounted.

In the drawings, a first preferred embodiment of the rack in accordance with the invention is illustrated in FIG. 1 at the reference numeral 10. The rack 10 includes a vertical support 12, at least one platform 14, and an axle 16. The support 12 includes four legs and maintains the platform 14 above the floor level. The platform 14 provides space to store replacement spools 8 containing spooled material. Having storage space on the rack frees up storage space.

Combining the storage and dispensing functions into one area (i.e., the rack) provides an efficient, neat, and safe way to store and dispense spooled materials.

Preferably, the support 12 is made of material that is both strong and will not bend, such as heavy 3/16 steel. The support 12 preferably has stabilizers 18 in the form of horizontal plates that sit on a floor and are attached to the support 12. The stabilizers 18 are secured to the floor or are on lockable casters. To increase the stability, plates, brackets, or the like (not shown) can be fixed between the support 12 and the stabilizers 18. Stabilizers 18 can also include vertically-protruding screws extending through them so that adjustment of screws allows for height and level adjustment.

The support 12 is a vertical support. This does not require that the support be vertically oriented. Rather, it requires that the platforms 14 be supported in a vertical array, wherein the peripheral edge of the platforms 14 need not necessarily be parallel or rest within the same plane.

The support 12 is preferably permanently affixed to the platform 14, for example by welding. The platform 14 is made from a material that is strong enough to withstand the weight of the spools 8. Preferably, the platform 14 is made from ½"×13/15" flat expanded metal. The rack 10 preferably has multiple platforms 14 to accommodate more replacement spools 8. The spacing of the platforms 14 can be modified such that different sized spools 8 can be placed on the platform 14. Spools 8 have a diameter and a width. The terms width and height, when applied to a spool 8, are interchangeable, merely depending on whether the spool 8 is placed on its end or side. Preferably, the spacing between the platforms 14 is greater than the diameter of the spool 8 being stored thereon. A single platform 14 can also provide room to stack multiple spools 8. Preferably, the type (e.g., gauge) of material on a spool 8 is the same on the axle 16 as it is on the platform 14 nearest the axle 16.

Along the peripheral edge of the platform 14, upwardly extending flanges 20 that extend about at least a portion of the platform 14 are included. Flanges 20 add structural strength and help prevent spools 8 from falling off of the platform 14.

The rack 10 also includes an axle 16 for rotatably receiving spools 8. The axle 16 is preferably ½" diameter thin-wall conduit. Because thin-wall conduit can deform if the weight of the spools is too great, also preferred for the axle 16 is a ⅝" solid steel rod, which, when compared to thin-wall conduit, can bear heavier spools 8 without deforming. The axle 16 is preferably horizontally displaced from a peripheral edge of the platform 14 (or the support 12) rather than resting over a platform 14, so that the axle does not interfere with the placement of spools 8 on the platform 14. The spacing between the axle 16 and the platform 14 (or the support 12) is preferably greater than the radius of the spool 8, but less than the spool 8 diameter. Thus, if a spool 8 rolls off the platform 14 toward the axle 16, the spool 8 will catch between the platform 14 and the axle 16, and the spool 8 cannot roll onto the floor.

The axle 16 can either be at the same height as the platform 14 as is shown on the left hand side of the rack 10 of FIG. 1, or it can be at a different height as shown on the right hand side of the rack 10 of FIG. 1. When the axle 16 is at a different height than the platform 14, the axle 16 can receive differently-sized spools 8. An axle 16 at the same height is preferred because this allows for easier rolling and sliding of a spool 8 off the platform 14 for loading the spool 8 onto an axle 16; additionally, axles 16 do not interfere with egress from platform 14.

The axle 16 is displaced from the peripheral edge of the platform 14 (or the support 12) preferably by arms 22 that are affixed to the platform 14 (or the support 12). The arms 22 can be at the lateral edge of the platform 14, or the arms 22 can be attached to the support 12. As shown in FIG. 1, both ends of the axle 16 can be removably mounted to the platform 14 (or the support 12) such that the axle 16 is removed when spools 8 are added or removed from the axle 16. Having the axle 16 removably mounted to the platform 14 permits a worker to remove the axle 16, and insert the axle 16 into a spool 8 while it is on the platform 14. The arm 22 receives the axle 16 by an indentation 24 that secures the axle 16 to the arm 22 when spooled material is being dispensed from the spool 8. Alternatively, the spool 8 can be removed from the platform 14 and added to the axle 16 that has been removed.

The arms 22 can be spaced inwardly from the lateral ends of the platform 14. This allows an axle 16 containing a spool 8 to be rolled along the platform 14 onto the arms 22 without interference from the support 12. For this, an axle 16 that has a length that is shorter than the distance between the legs of the support 12 is preferred, and the arms 22 are preferably attached to the platform 14. The worker then can roll the spool-laden axle 16 off the platform 14 and lower the spool-laden axle 16 until it reaches the arms 22, and roll the spool-laden axle 16 along the arms 22 until it falls into the indentations 24 of the arms 22. This allows ready insertion and removal of the axle 16 and allows a user to install spools 8 with less lifting of the spool-laden axle 16 required.

The indentations 24 in the arms 22 can accommodate differently-sized axles 16 and have greater shear strength than if the axles 16 extended through bores axially extending through the arms 22. Preferably, the indentations 24 for holding the axle 16 to the arm 22 are V-shaped cutouts in the top of the arm 22. Also preferred is a rectangular cutout in the arm 22. Multiple indentations 24 can be provided on each arm 22, such that the axle 16 can be situated at different locations along the arms 22 to place the axle 16 at different distances from the platform 14. The upper arm 22 on the lefthand side of the rack 10 in FIG. 1 shows an arm 22 with multiple indentations 24.

Optional enlarged-diameter caps 26, cotter pins, or other stops can be placed on the ends of the axle 16 to ensure that the axle 16 opposes horizontal displacement along its axis and remains in the indentations 24, thereby preventing the axle 16 from falling.

Figure 2:
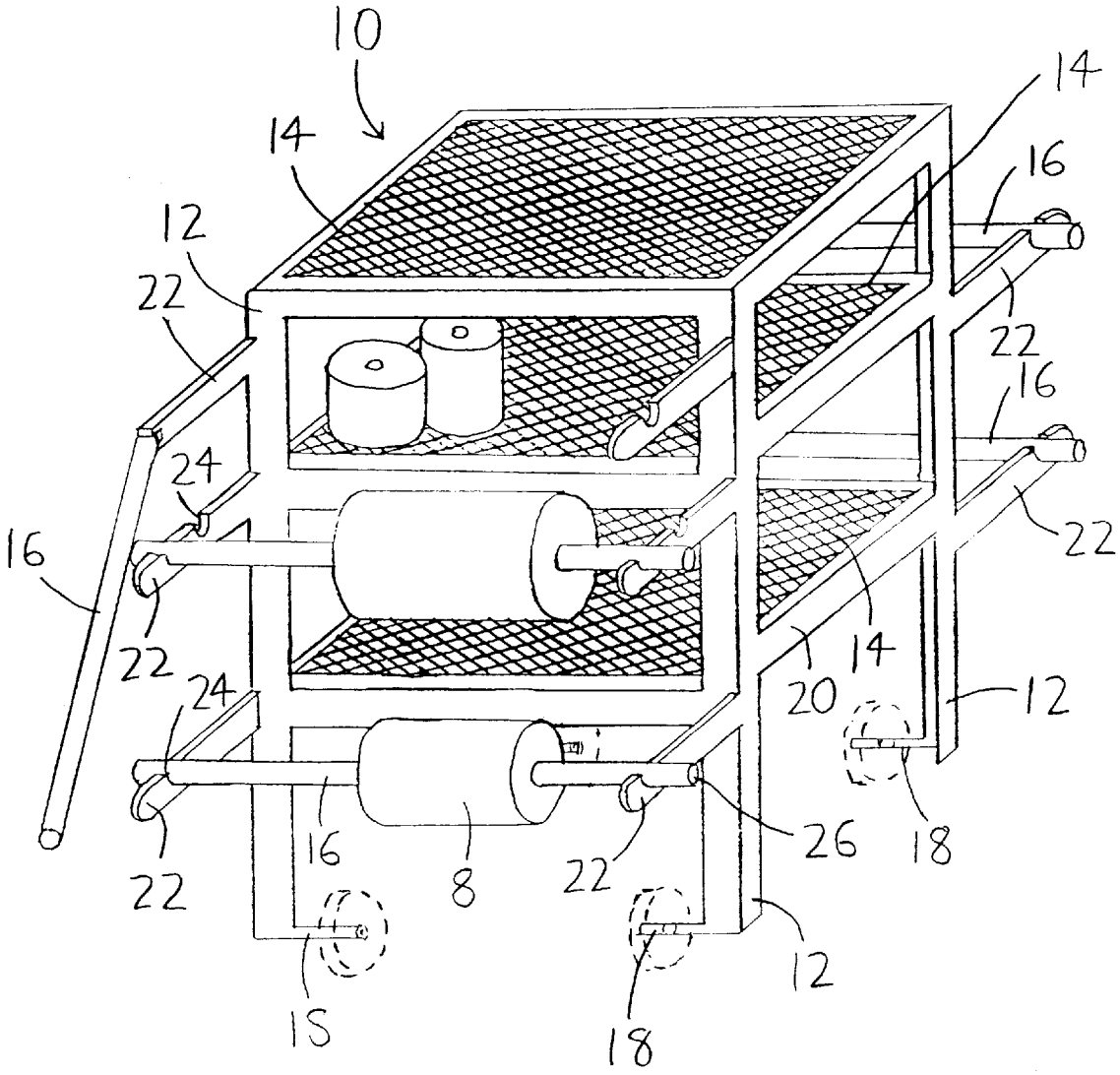
FIG. 2 is a perspective view of a preferred embodiment of a storing and dispensing rack having an axle that is pivotally mounted.

Alternatively, as is shown in FIG. 2 a first end of the axle 16 is pivotally mounted to the platform 14 or the support 12 via the arm 22 and the second end is removably mounted. For example, the second end of the axle 16 is secured in the arm 22 by disposing the second end in an indentation 24 of an arm 22. In the secured position, the axle 16 dispenses spooled material from the spools 8 that are rotatably received on the axle 16. When a spool 8 needs to be replaced, the second end of the axle 16 is removed from the indentation 24 of the arm 22 (the securing arm 22), thereby freeing the second end. The axle 16 is moved away from the securing arm 22 by pivoting the axle's first end at its arm 22. This permits removal of an empty spool 8 and adding of a replacement spool 8. Once the replacement spool 8 is added, the axle 16 is pivoted toward the securing arm 22, and the second end is secured in the indentation 24 of the securing arm 22. This configuration requires less strength from the user who is adding or removing spools 8.

EXAMPLES

The following examples are provided for illustrative purposes only. It is understood that the following examples do not limit the invention claimed herein in any way.

Example 1

A 2 foot wide×2 foot long×8 foot high rack made in accordance with the present invention was installed on a production floor. The rack replaced a conventional rack that consumed an 8 square foot area on the production floor. The conventional rack held 26,000 feet of wire. In contrast, the rack made in accordance with the present invention held 160,000 feet of wire and consumed a 4 square foot area.

Example 2

A 2 foot wide×2 foot long×8 foot high rack made in accordance with the present invention was installed. The inventive rack freed up 130 square feet of storage space and replaced nine conventional racks.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

First, the invention encompasses racks 10 having either one platform 14 or multiple platforms 14. Racks 10 can have axles 16 on one side of the rack 10 or on two, three, or four sides.

Second, the invention encompasses racks 10 made with different materials than are described in the preferred embodiments. Materials are limited only by the amount of weight of the spools 8 themselves and the spooled material that the rack must maintain. For instance, if the spools 8 contain lighter weight spooled material such as thread, then the materials used to make the rack could have lesser strength than materials required to hold heavier weight material like wire.

Third, instead of having four legs, the support 12 could also have two vertical members such as planar members or sides. The advantage of having four spaced legs is that the legs allow egress of the spools 8 via the spaces therebetween. Thus, workers can access stored spools between the legs.

Fourth, additional axles 16 that have a first end mounted to the platform 14 or support 12 and a second end displaced from the rack 10 can be added to the rack 10. The additional axles 16 provide supplementary dispensing capability.

Fifth, the support 12 can have adaptations to a leg or legs to permit fitting the rack 10 into a work space that has structural features, such as pipes, that either already are present in that work space or will be added to it.

Sixth, the assembly of the racks 10 does not have to be permanent. Instead, parts such as platforms 14 can be detachable to allow for variable height, for location to be changeable, for addition of platforms 14, and for other modifications.

Seventh, the indentations 24 on the arms 22 to secure the axle 16 could be replaced with another structure for securing. For example, two upright members could be attached to the arms 22 for holding the axle 16 in place. Alternatively, a single member with an indentation 24 could be attached to the arms 22.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A rack for storing and dispensing material, the rack comprising:

at least one spool storage platform, the platform having a peripheral edge and being substantially horizontally oriented;

at least three vertically disposed legs attached to the platform and defining an area, said platform being supported by said legs in said area, wherein the legs include means for rolling mobile transportation;

a first arm attached to one of the vertically-disposed legs and a second arm attached to another of the vertically-disposed legs, each of the first and second arms projecting outward from the leg to which it is attached and away from said platform, and the second arm having an upper surface having an indentation therein; and an axle having a first end and a second end, wherein the first end of the axle is pivotally connected to the first arm and wherein the second end of the axle engages the indentation in the upper surface of the second arm, to thereby hold the axle in position.

2. The rack of claim 1, wherein the rack further comprises a spool rotatably disposed about the axle.

3. The rack of claim 1, further comprising an upwardly-extending flange extending about at least a portion of the peripheral edge of the platform.

4. The rack of claim 1, wherein the means for rolling mobile transportation comprise lockable casters.

* * * * *